US005486071A

United States Patent [19]

Bullivant

[11] Patent Number: 5,486,071

[45] Date of Patent: Jan. 23, 1996

[54] METHOD AND APPARATUS FOR SUPPORTING A LOAD

[75] Inventor: Roger A. Bullivant, Burton-on-Trent, England

[73] Assignee: Roger Bullivant of Texas, Inc., Grand Prairie, Tex.

[21] Appl. No.: 19,120

[22] Filed: Feb. 17, 1993

[30] Foreign Application Priority Data

Feb. 19, 1992 [GB] United Kingdom ..... 9203481
Apr. 11, 1992 [GB] United Kingdom ..... 9208059

[51] Int. Cl.[6] ..... E02D 5/60; E02D 7/02

[52] U.S. Cl. ..... 405/229; 405/230; 405/233

[58] Field of Search ..... 405/229, 230, 405/233, 239, 256, 257, 252, 254, 253, 232

[56] References Cited

U.S. PATENT DOCUMENTS

| | | | |
|---|---|---|---|
| 272,426 | 2/1883 | Gray et al. | 405/255 X |
| 788,410 | 4/1905 | Koetitz | 405/257 X |
| 794,971 | 7/1905 | Ericsson | 405/233 |
| 975,488 | 11/1910 | Welsh | 405/257 X |
| 1,063,869 | 6/1913 | Goldsborough | 405/230 |
| 1,447,254 | 3/1923 | Langworthy | 405/256 |
| 1,644,572 | 10/1927 | Ferry et al. | 405/230 |
| 1,681,883 | 8/1928 | Sipe | 405/239 |
| 1,792,333 | 2/1931 | Takechi | 405/256 X |
| 1,856,517 | 5/1932 | Smith | 405/233 |
| 1,979,670 | 11/1934 | Brune et al. | 405/230 |
| 2,008,521 | 7/1935 | Takechi | 405/233 |
| 3,352,120 | 11/1967 | Pelzey | 405/256 X |
| 3,570,258 | 3/1971 | Fuller | 405/233 |
| 3,796,055 | 3/1974 | Manony | 405/230 |
| 4,018,056 | 4/1977 | Poma | 405/233 |
| 4,040,260 | 8/1977 | Pryke | 405/239 |
| 4,060,994 | 12/1977 | Chitis | 405/239 X |
| 4,063,423 | 12/1977 | Gurkoy et al. | 405/239 |
| 5,070,672 | 12/1991 | Bullivant | 52/742 |
| 5,228,807 | 7/1993 | Willcox | 405/255 X |

FOREIGN PATENT DOCUMENTS

| | | |
|---|---|---|
| 0121003 | 10/1984 | European Pat. Off. . |
| 0523632 | 7/1940 | United Kingdom . |

*Primary Examiner*—Dennis L. Taylor
*Attorney, Agent, or Firm*—Richards, Medlock & Andrews

[57] ABSTRACT

A pile (18) has a preformed disc-like load spreading member (34) fixed to its upper end after the pile (18) has been driven into the ground. A recess (16) is formed around the top of the pile and can be filled with particulate material (22) to position the load spreading member (34) while a bonding agent (23) fixing the load spreading member (34) to the pile (18) sets. A downwardly converging hollow concrete conical member (40), driven into the ground, has a cover (46) placed thereon to distribute the load to the conical member (40). A pile (56) can be driven through the hollow chamber of the conical member (40) and fixed to the conical member (40) by pouring concrete into the chamber after the pile (56) has been driven.

12 Claims, 2 Drawing Sheets

METHOD AND APPARATUS FOR SUPPORTING A LOAD

FIELD OF THE INVENTION

The present invention relates to improvements in method of and apparatus for providing elements in the ground for supporting loads. In a particular aspect, the invention relates to an improved pile assembly comprising a pile member having an enlarged preformed pile head fixed thereto at or near ground level. In another aspect, the invention relates to a hollow concrete member adapted to be driven into the ground, which permits a pile member to be driven therethrough, and which can be provided with a preformed cover so as to serve as an enlarged pile head for supporting a structure.

BACKGROUND OF THE INVENTION

Certain constructions involving piles require that the head of the pile member have lateral dimensions which are greater than those of the pile member. For example, with a pile member having a circular cross-section, the diameter of the pile head can exceed that of the pile member by a factor of three or more. Such assemblies are useful in the support of stepped beams spanning the gaps between neighboring pile members, the beams having upwardly directed steps on which floor panels or blocks can be supported.

One method of forming piles with enlarged heads, which is described in U.S. Pat. No. 5,070,672, drives a hollow casing into the ground to form an opening which tapers downwardly and inwardly. The hollow casing can have an upper section, an intermediate section which tapers inwardly and downwardly, and a bottom section which tapers inwardly and sharply downwardly. After the casing has been driven into the ground so that its top is at ground level, a pile member is positioned within the hollow of the casing and then driven into the ground below the casing. After the pile member has been driven downwardly so that its top end is located at a pre-arranged depth within the casing, the casing is removed and the resulting hole around the upper end of the pile member is filled with concrete to form a pile head. Thus, the pile head has an inverted generally conical configuration from which the pile member extends downwardly into the ground. While this method is advantageous in many situations, in certain circumstances this method can be disadvantageous as the pile forming technique calls for at least the pile head to be formed in situ, almost invariably by the pouring of concrete into a preformed hole. As it is often difficult to ensure that the concrete is delivered at exactly the required time and as the pouring and setting of concrete depends to an extent on weather conditions, it is sometimes desirable that the pouring of concrete to form elements on site be avoided, or at least minimized.

It is an object of the present invention to obviate or mitigate these and other disadvantages.

SUMMARY OF THE INVENTION

According to the present invention, there is provided a method of and assembly for supporting a load on the ground, wherein a load supporting member is located in the ground, a recess is provided at the top portion of the load supporting member, and a preformed load distributing member is fitted to the load supporting member over the recess. The load supporting member can be a pile member with the upper portion thereof being surrounded by a recess in the ground. The preformed load distributing member can be a pile head having a transverse cross-sectional area perpendicular to the longitudinal axis of the pile member which is greater than the transverse cross-sectional area of the pile member perpendicular to the longitudinal axis of the pile member, and is preferably fixed to the top portion of the pile member by a suitable bonding agent.

The recess is preferably a downwardly converging recess. The recess can be formed by forcing into the ground a forming element having a shape corresponding to the desired recess. The forming element can be removed from the recess prior to the pile member being driven through the recess, or if the forming element has an open bottom end, the forming element can be removed from the recess after the pile member has been driven. Prior to fitting the preformed pile head onto the pile member, the recess can be at least partially filled with a particulate material to at least initially provide support for the pile head.

In one specific embodiment of the invention, the pile member is a preformed reinforced concrete pile which is driven into the ground in a normal manner and which is provided with an upper end portion of reduced transverse dimensions. The preformed pile head is attached to the pile at or near ground level after the pile has been driven. The preformed pile head has a central opening, the dimensions of which correspond to the reduced dimensions of the upper end portion of the pile such that the pile head can be fitted over the upper end of the pile. A bonding agent is applied to the pile and/or pile head to bond the pile head to the pile. A ring, fitted around the pile, can be used to hold the bonding agent in place.

In another specific embodiment of the invention for providing a pile assembly formed of a reinforced concrete pile with a preformed reinforced concrete pile head at or near its upper end, the method comprises forming a recess extending downwardly from ground level in the ground to be piled, driving a reinforced concrete pile, having a centrally located axially extending reinforcement member, downwardly from the base of the recess until the pile reaches a predetermined depth at which stage the top end of the pile is at or above the upper level of the recess, removing concrete from the top end of the pile to expose the reinforcing member from the top end downwardly to a predetermined level in the recess below ground level, placing a layer of a bonding agent on the top end of the concrete of the pile surrounding the exposed reinforcing member, and placing a preformed pile head around the exposed reinforcing member and on the bonding agent at a predetermined inclination and level so that the bonding agent attaches the pile head to the pile at the desired position relative thereto.

Further according to the present invention, there is provided a method of and an assembly for spreading an applied load, comprising a load supporting member which can be driven into the ground and is surrounded by or encloses a recess in the ground, with a load distributing cover being supported on the upper portion of the load supporting member. The load supporting member can be a hollow downwardly converging member enclosing a recess, with the cover being supported by the hollow downwardly converging member and bridging the recess. A pile can project downwardly from the recess, and the recess can be partially filled with a settable material to bond the pile to the hollow downwardly converging member.

In a specific embodiment of the invention, a load bearing assembly comprises a hollow downwardly converging concrete member adapted to be driven into ground on which a building structure has to be supported, and a cover for covering the driven member and adapted to support the building structure on the driven member. The downwardly converging member can have a closed base, but is preferably frustoconical with an open base. The assembly can also include a pile driven through the base of the downwardly converging member and fixed thereto. A bonding agent can be poured into the bottom of the hollow chamber of the downwardly converging member, after the pile is driven, in order to affix the pile to the hollow member. The cover is preferably a preformed reinforced concrete member.

Further according to the present invention there is provided a method of supporting a building structure comprising placing a plurality of hollow downwardly converging members into the ground at spaced intervals with the top of the hollow downwardly converging members being at or near ground level, fitting covers over the top of the hollow downwardly converging members, and laying beams thereon on which the building can be constructed. In certain instances a pile can be formed through the open base of a hollow downwardly converging member after the hollow downwardly converging member has been placed in the ground, and the pile can then be attached to the downwardly converging member by pouring a bonding agent into the bottom of the hollow of the downwardly converging member around the portion of the pile housed therein.

BRIEF DESCRIPTION OF THE DRAWINGS

An embodiment of the present invention will now be described by way of example only with reference to the accompanying drawings, in which.

DETAILED DESCRIPTION

Figure 1:
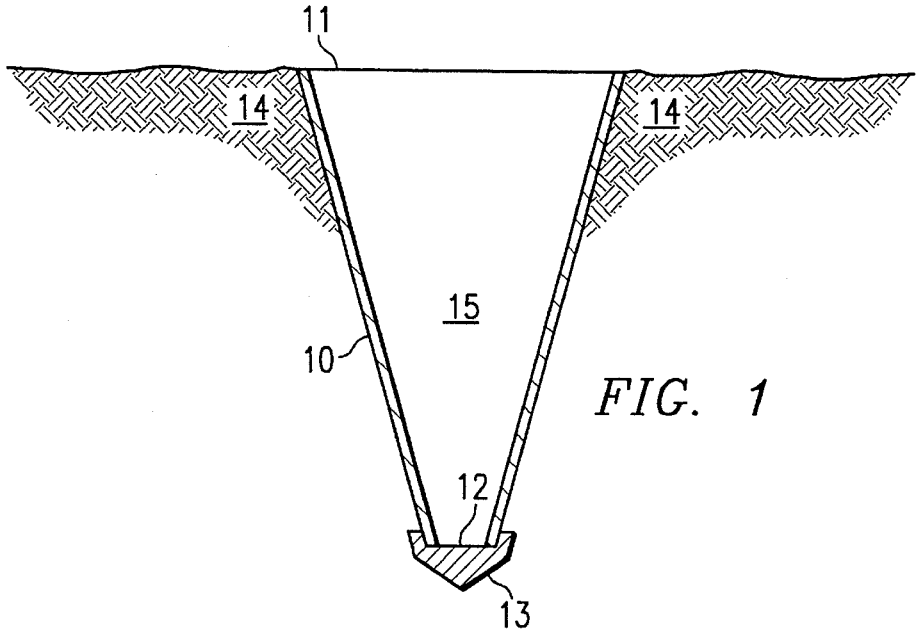
FIG. 1 is an elevation view in cross-section through ground to be piled after a downwardly converging recess has been formed therein.

It is desirable to provide a load bearing assembly for supporting a structure on the ground, wherein the major components of the load bearing assembly are preformed so as to minimize on-site fabrication. Accordingly, a first embodiment of the invention utilizes axially extending precast reinforced concrete piles 18 to provide a piled foundation for a building structure, wherein each of the pre-cast piles 18 has a relatively small diameter and is provided with a separate precast enlarged cap or pile head 30, whereby the assembly can readily support beams as well as give the beams adequate resistance to rotational movement. The transverse dimensions of the separate pile head 30 will be substantially greater than the corresponding transverse dimensions of the pile 18, with the maximum transverse cross-sectional area of the pile head 30 perpendicular to the longitudinal axis of the pile 18 preferably being at least eight times, and more preferably at least ten times, greater than the maximum transverse cross-sectional area of the pile 18 perpendicular to the longitudinal axis of the pile 18.

When a position has been selected for a pile 18, a forming element 10 of inverted generally conical shape can be pressed into the ground 14 with the longitudinal axis of the forming element 10 being coincident with the desired position of the longitudinal axis of the subsequently driven pile 18. The transverse dimensions of the top end 11 of the forming element 10 perpendicular to the longitudinal axis of the forming element 10 are substantially larger than the corresponding dimensions of the bottom end 12 of forming element 10 perpendicular to the longitudinal axis of the forming element 10. The forming element 10 is preferably made of steel and can be driven into the ground 14 by the application of a dead weight, vibrations, or hammering impact forces.

Depending upon the condition of the ground 14 in which the forming element 10 is driven, the forming element 10 can then be removed from the ground, thereby leaving behind a recess 16 whose shape and dimensions correspond to the outside shape and dimensions of the forming element 10. Thus, with an at least generally frustoconical forming element 10, the recess 16 will have a corresponding at least generally frustoconical configuration with the top of the recess 16 being larger than the bottom of the recess 16. Alternatively, if it appears that the ground might collapse on the removal of the forming element 10, a hollow forming element 10 with an open base 12 can be employed so that it can remain in place in the ground while a pile 18 is positioned in the chamber 15 of the hollow forming element 10 and then driven downwardly through the open base 12 of the forming element 10. When the forming element 10 is to be removed prior to the driving of the pile 18, the forming element 10 can be in the form of a complete cone, either solid or hollow, with the bottom end 12 having a sharp apex to assist in the forcing of the forming element 10 into the ground. However, a hollow frustoconical shape is preferred for forming element 10, in order to provide an open base 12 through which the pile 18 can be driven. A separate cone head 13 can be positioned under the open base 12 of a frustoconical forming element 10 to provide the complete conical shape for forcing the forming element 10 into the ground, but which can be readily separated from the forming element 10 while the forming element 10 is in place in the ground, so as to provide an opening through which the pile 18 can be driven.

While the pile 18 can have any suitable transverse cross-section and be formed of any suitable materials, preferably the pile 18 has a circular transverse cross-section perpendicular to its longitudinal axis, is formed from reinforced pre-cast concrete, and has at least one centrally located steel reinforcing member 19, e.g., a reinforcing bar, which extends axially for substantially the entire length of the pile 18 and is surrounded by concrete. In general, the axial length of the pile 18 will be several times the axial length of the recess 16.

The pile 18 can be driven into the ground by any suitable means so that the bottom end of the pile 18 reaches a predetermined depth, with the longitudinal axis of the pile 18 extending in the desired direction, which normally will be at least generally vertically. After the pile 18 has been driven to the desired depth, the upper portion of the pile 18 can be cropped to eliminate any excess length, if necessary, such that the top end of the pile 18 is at the desired support level. The desired support level will generally coincide with the ground surface level L, but can be at a level above or below the ground surface level L. When the top end of the pile 18 is at the desired support level, the upper end portion of the driven pile 18 will be surrounded by the recess 16.

At least the peripheral portion of the concrete surrounding the upper end of the reinforcing member 19 in the cropped pile 18 can then be removed by any suitable technique, e.g., chipping, so as to leave the reinforcing member 19 (now terminating at the desired support level) in place, and preferably exposed. Concrete removal is continued downwardly along the axial length of the pile 18 until the resulting upper face of the concrete shoulder 17 formed by the transition from the original pile diameter to the reduced pile diameter is at or just below a desired level 20 for the pier head 30. Alternatively, the pile 18 can be preformed with the desired axial length and with the transverse cross section of the upper end portion of the pile 18 perpendicular to its longitudinal axis being smaller than the transverse cross section of the portion of the pile 18 perpendicular to its longitudinal axis immediately below the upper end portion so as to preform the upwardly facing annular shoulder 17.

The recess 16 is then filled with particulate material 22 up to at least the desired level 20 for the pile head 30. The particulate material 22 is preferably an inert material which will supports the pile head at least until the pile head 30 has been bonded to the pile 18. Preferably, the particulate material 22 comprises beads of an inert plastic material, e.g., polystyrene beads. Alternatively, if the forming element 10 has remained in place during the pile driving operation, the forming element 10 can be removed and thereafter the particulate material 22 can be immediately poured into the recess 16 to fill the recess to the desired level 20.

At this stage a retaining ring 21 can be fitted around the pile 18 with the upper edge of the ring 21 being coincident with desired level 20. The retaining ring 21 can be formed from a flexible sheet or board which is deformable to surround the pile shoulder 17 and be held in place by any suitable means, e.g., a clamp or an elastic band. A bonding agent 23, e.g., a quick setting cementitious material, an epoxy resin, or any other adhesive suitable for bonding the pile head 30 to the pile 18, is applied to the concrete pile shoulder 17 so as to fill the annular space on top of the concrete shoulder 17 and around the exposed reinforcing member 19 as defined by the retaining ring 21. The preferred adhesive is an epoxy resin.

In ground which is subject to heaving, a length of the pile 18 immediately below the recess 16 can be provided with an annular layer 25 of material having a low coefficient of friction in order to allow the ground surrounding that length of the pile 18 to heave without disturbing the position of the pile 18. Such layer 25 can be in the form of a coating directly applied to the pile 18 or a separate sleeve fitted around the pile 18. The upper end of the recess 16 can be provided with a rim 27 of enlarged diameter to ensure that the pile head 30 is spaced from the surrounding ground 14, especially if the ground is subject to heaving. The vertical height of the enlarged rim 27 is preferably equal to, and more preferably slightly greater than, the vertical thickness of the preformed pile head 30 so as to avoid direct contact between the preformed pile head 30 and the surrounding ground.

A preformed pile head 30, preferably in the form of an annular reinforced concrete pile head having a central passage 32 therethrough, is now placed over the exposed upper end of the reinforcing member 19 and rests on the upper surface of the particulate material 22 and the still unset adhesive 23 on shoulder 17. The dimensions of the centrally located axially extending passage 32 through pile head 30 are slightly larger than the corresponding external dimensions of the pile reinforcing member 19 and substantially smaller than the corresponding external dimensions of the portion of the pile 18 immediately below the shoulder 17, so that shoulder 17 provides adequate surface for supporting the pile head 30 and for transferring vertical loads from the pile head 30 to the pile 18. In view of the relatively fluent nature of the particulate material 22 and adhesive 23, it is a simple matter to ensure that the pile head 30 is at the correct predetermined level 20 and at the correct predetermined inclination, almost invariably horizontal. The thickness of the pile head 30 is preferably at least substantially equal to the length of the upper end portion of pile 18 having reduced dimensions, such that the top of the pile 18 is at least substantially flush with the top surface of the pile head 30 in the completed assembly.

When the pile head 30 has been mounted in its desired position, it can be further fixed to the top of the pile 18 by pouring a suitable bonding agent, e.g., a fast setting cementitious grout, an epoxy resin, or any other suitable adhesive, into the annular space 34 between the inside vertical wall surface of pile head 30 and the external vertical surface of the length of the upper end portion of the pile 18 having reduced dimensions.

When the bonding material on the shoulder 17 and in the annular space 34 has set, a pile assembly having the desired characteristics is provided in the correct location at the correct level. When further subsequent pile assemblies of a similar nature have been formed, a system of structural beams 36 can be laid thereon, the pile assemblies supporting the beams 36 not only in the vertical direction but also against any twisting moments applied thereto, as the pile heads 30 provide a much wider base for the beams 36 than would have been achieved if no enlarged pile heads 30 had been provided on the piles 18. One or more of the beams 36 can have flanges extending laterally from their lower portion so as to support cross beams, brickwork, etc.

This piling technique can employ prefabricated components with the exception of the grout or adhesive between the pile 18 and the pile head 30 so that no "wet trades" labor, apart from the mixing of a small amount of adhesive or grout, is required on site. This is a considerable advantage over existing techniques in that the pile driving team is not reliant upon the delivery of ready mixed concrete nor is it reliant on weather conditions enabling poured concrete to set satisfactorily.

The polystyrene beads 22 which remain under the pile head 30 in the recess 16 provide an added advantage in that if the ground 14 into which the recess 16 has been formed is subject to heaving, for example on change of moisture content, that movement is not transmitted to the pile head 30 or to the section of the pile 18 within the recess 16.

Figure 3:
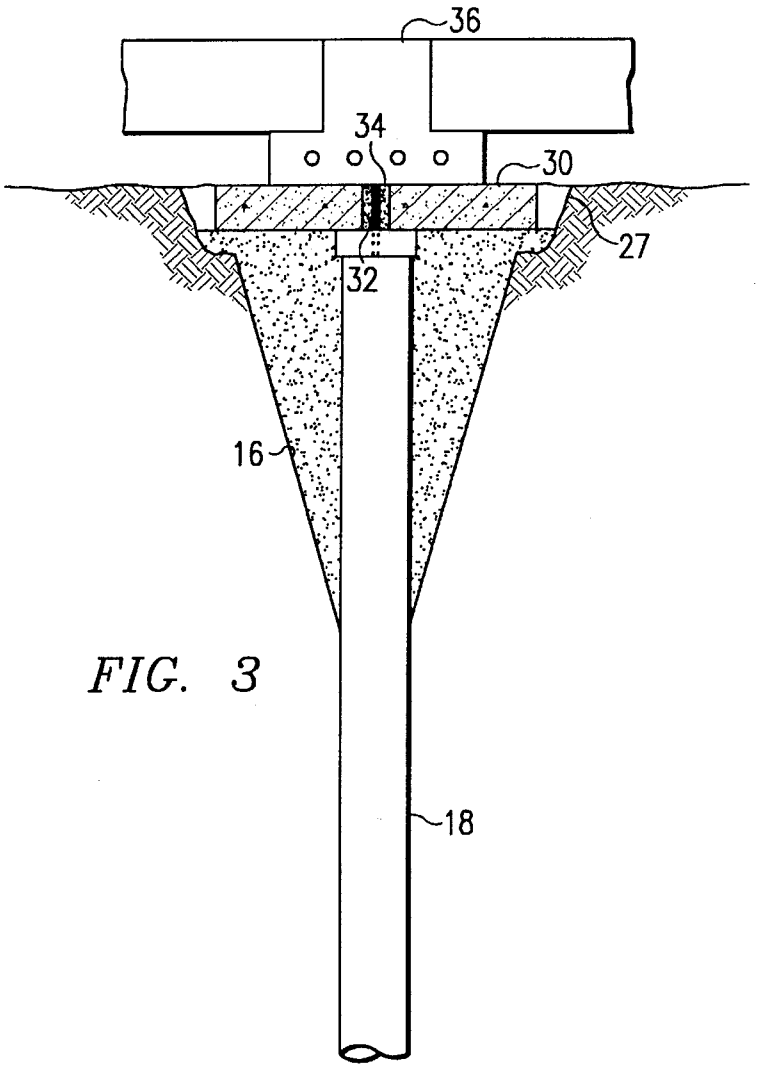
FIG. 3 is an elevation view, partly in cross section, which shows the completed pile assembly supporting a structural member.
Figure 2:
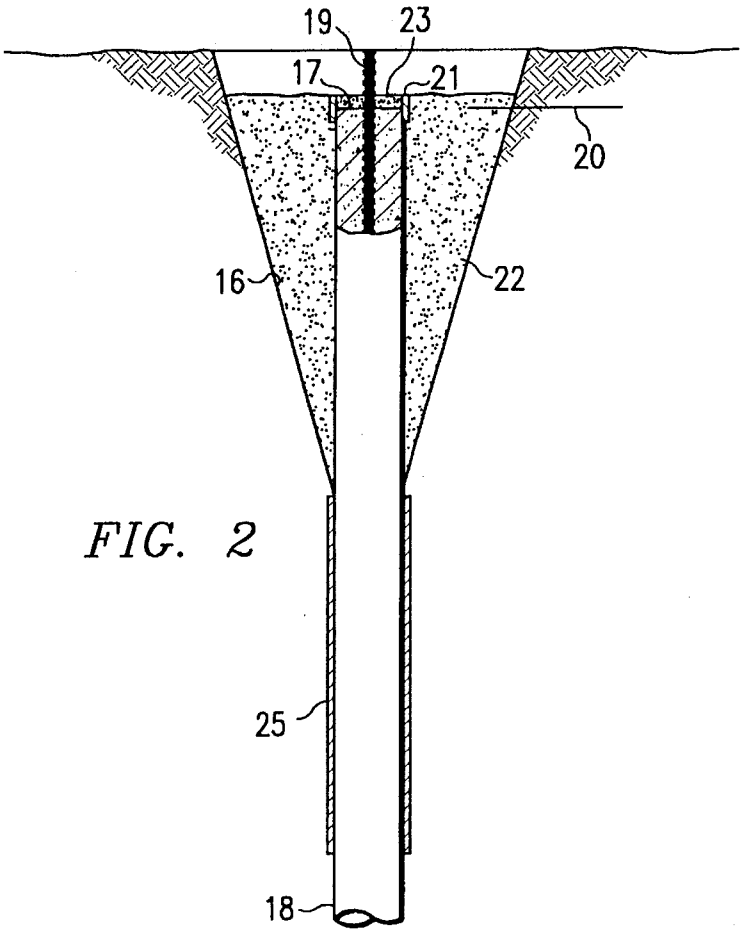
FIG. 2 is an elevation view, partly in cross section, which illustrates a subsequent stage of the piling method after a pile has been driven and the recess has been filled with a particulate material.

Various modifications can be made without departing from the scope of the invention as illustrated in FIGS. 1–3, for example, the pile 18 can be constructed in sections, can be of any external configuration, and can have two or more reinforcing members 19 offset from each other provided that the passage(s) 32 in the pile head 30 have a corresponding configuration, size and location. The transverse cross section of the pile head 30 need not be circular but could be rectangular, hexagonal, or any other convenient shape. The side walls of the pile head 30 can be vertical or at an acute angle to the vertical. The recess 16 can have a pyramidal shape, and it can be relatively shallow, for example dug out manually. The base of the pile head 30 could be convex instead of planar. It is possible in a further modification, especially with a shallow recess 16, to dispense with the polystyrene beads 22.

Figure 4:
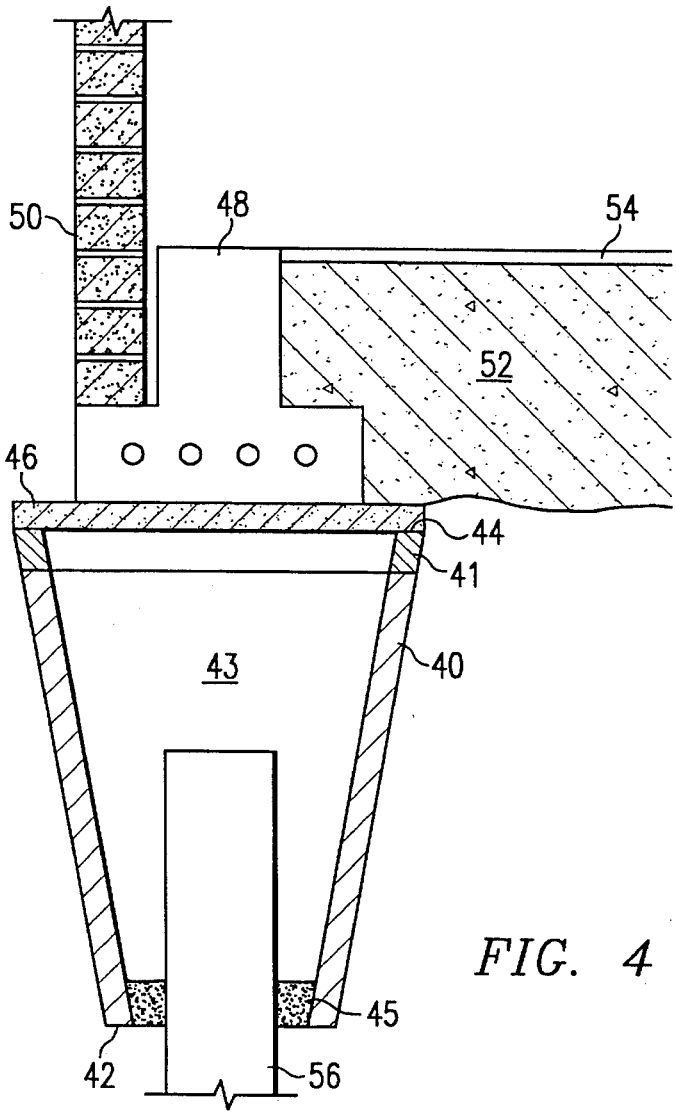
FIG. 4 is an elevation view, partly in cross section, which shows a support assembly for a building structure.

Another foundation system in accordance with the invention, in which the minimum of "wet trade" labor is required at the site, is illustrated in FIG. 4. This system is intended for use principally in ground which is relatively stable over its first meter or so depth from ground surface level. The system utilizes a plurality of hollow downwardly converging precast concrete members 40 which are permanently placed in the ground. In a specific frustoconical version, the diameter of the base 42 of the downwardly converging member 40 is about 0.45 m, the diameter of the top 44 of the downwardly converging member 40 is about 0.6 m, and the longitudinal axial length of the downwardly converging member is about 1.0 m. However, the dimensions can be varied in accordance with the circumstances of use. Preferably, the recess 43 in the downwardly converging member 40 also has downwardly converging side walls. The top end portion of the downwardly converging member 40 can be formed by a steel ring 41 so as to strengthened the downwardly converging member 40 and provide for a more uniform transfer of driving forces to the downwardly converging member 40.

After locating the desired position for a downwardly converging member 40, it can be forced into the ground by the application of a downwardly directed force on its upper end 44. The downwardly directed force can be a vibratory force, a series of impact forces, or a constantly applied force. If a cylindrical member, whether hollow or solid, were to be forced into the ground, the diameter of the hole surrounding the cylindrical member would normally increase during the driving operation, and the annular space thus created between the surrounding ground and the cylindrical member would allow some movement of the cylindrical member. However, with the particular downwardly converging frustoconical configuration envisaged in the present invention, even if an annular space were to be formed, such space would be taken up as the downward driving of the frustoconical member 40 continues, whereby the frustoconical member 40 is firmly fixed within the ground. This results in the frustoconical member 40 giving a good upward thrust effect, not only as a result of the frictional forces on its sides but also the vertical component of the load bearing forces on the downwardly converging sides.

When the downwardly converging member 40 has been fully driven into the ground, normally when its upper end 44 reaches ground surface level or slightly therebelow, a preformed reinforced concrete cover slab 46 is placed over the upper end of the downwardly converging member 40 bridging the recess 43, thereby enabling a reinforced concrete beam 48 spanning adjacent downwardly converging members 40 to be supported thereon. The beam 48 can have flanges extending laterally from its lower portion, the outer flange supporting, for example, brickwork 50. Internally of the beam 48 there can be formed a floor of, for example, foamed concrete 52 with a wear layer 54 thereon.

In one version, the lower end 42 of the downwardly converging member 40 can have a base cap (not shown) secured thereto to aid in the driving of the downwardly converging member 40 into the ground. Another version of downwardly converging member 40, which can be advantageously employed to provide further load bearing characteristics if the ground surrounding the downwardly converging member 40 is insufficiently stable, has an open base or a readily separatable base cover so that a precast concrete pile 56 can be driven downwardly through the chamber 43 and the base opening 42 of downwardly converging member 40, the pile 56 taking the separated base cover, if present, downwardly with it as the pile 56 descends into the ground. The pile 56 can be driven downwardly until it projects downwardly from a point with the recess 43. The pile 56 can then be suitably mechanically connected to the downwardly converging member 40 by pouring a bonding material 45, e.g., a quick setting cementitious material, an epoxy resin, or any other adhesive suitable for bonding the pile 56 to the downwardly converging member 40, into the chamber 43 to at least partially fill the annular space between the portion of the pile 56 located in the recess and the adjacent walls of the recess 43. Concrete and grout are the present preferred bonding materials for this application. The pile 56 can be of the type described in our co-pending European Patent Application 90904877.9.

Various modifications can be made without departing from the scope of the invention as illustrated in FIG. 4. For example, the bottom portion of the chamber 43 could be formed to closely fit the pile 56, thereby reducing the amount of bonding material required. The transverse cross-section could be rectangular instead of circular. The pile 56 could be driven so that its top end is flush with the top end of the downwardly converging member 40, thereby strengthening the resistance of the cover 46 to deformation.

Other reasonable variations and modifications are possible within the scope of the foregoing description, the drawings and the appended claims to the invention.

That which is claimed:

1. A load bearing assembly for supporting a structure on the ground, said assembly comprising:

an axially extending preformed pile member adapted to be located at least generally vertically in the ground;

a separate preformed load bearing pile head adapted to be supported on the upper end portion of said pile member, with the transverse dimensions of said pile head being substantially greater than the corresponding transverse dimensions of said pile member;

wherein said pile member is located at least substantially vertically in the ground with the upper end portion of said pile member being surrounded by a recess in the ground, said recess being filled with particulate material up to at least the level of said pile head, said recess having an at least generally frustoconical configuration with the top of said recess being larger than the bottom of said recess;

wherein the transverse cross section of the upper end portion of said pile member perpendicular to the longitudinal axis of the pile member is smaller than the transverse cross section of the portion of said pile member immediately below said upper end portion perpendicular to the longitudinal axis of said pile member so as to form an upwardly facing shoulder; and wherein said pile head has an opening therethrough with the dimensions of said opening being larger than the corresponding dimensions of said upper end portion of said pile member and smaller than the corresponding dimensions of the portion of said pile member immediately below said upper end portion, the pile head being fitted over said upper end portion of said pile member and supported on said shoulder and said pile head being bonded to said pile member.

2. A load bearing assembly in accordance with claim 1, wherein said pile member is a preformed concrete pile having a centrally located axially extending reinforcing member surrounded by concrete.

3. A load bearing assembly in accordance with claim 2, wherein said pile head is attached to the preformed concrete pile by a quick setting cementitious material.

4. A load bearing assembly in accordance with claim 2, wherein said pile head is bonded to the preformed concrete pile by a suitable adhesive.

5. A load bearing assembly for supporting a structure on the ground, said assembly comprising:

an axially extending preformed pile member adapted to be located at least generally vertically in the ground;

a separate preformed load bearing pile head adapted to be supported on the upper end portion of said pile member, with the transverse dimensions of said pile head being substantially greater than the corresponding transverse dimensions of said pile member;

wherein the transverse cross section of the upper end portion of said pile member perpendicular to the longitudinal axis of said pile member is smaller than the transverse cross section of the portion of said pile member immediately below said upper end portion perpendicular to the longitudinal axis of said pile member so as to form an upwardly facing shoulder; and wherein said pile head has an opening therethrough with the dimensions of said opening being larger than the corresponding dimensions of said upper end portion of said pile member and smaller than the corresponding dimensions of the portion of said pile member immediately below said upper end portion such that the pile head can be fitted over said upper end portion of said pile member and supported on said shoulder.

6. A load bearing assembly in accordance with claim 5, wherein said pile head is bonded to said pile member.

7. A load bearing assembly in accordance with claim 5, wherein said pile member has a centrally located axially extending reinforcing member surrounded by concrete.

8. A load bearing assembly in accordance with claim 5, wherein said pile head is attached to the pile member by a quick setting cementitious material.

9. A load bearing assembly in accordance with claim 5, wherein said pile head is bonded to the pile member by a suitable adhesive.

10. A load bearing assembly in accordance with claim 5, wherein said pile member is located at least substantially vertically in the ground with the upper end portion of said pile member being surrounded by a recess in the ground, said recess being filled with particulate material up to at least the level of said pile head.

11. A load bearing assembly in accordance with claim 10 wherein said recess has an at least generally frustoconical configuration with the top of said recess being larger than the bottom of said recess.

12. A load bearing assembly in accordance with claim 11, wherein said pile head is bonded to said pile member.

* * * * *